US006488085B1

(12) United States Patent
Milne et al.

(10) Patent No.: US 6,488,085 B1
(45) Date of Patent: Dec. 3, 2002

(54) METHOD AND APPARATUS FOR WELL LOGGING AND WELL CONTROL

(75) Inventors: Alex Watson Milne, Aberdeen; Michael Charles Spencer, Melton Mowbray, both of (GB)

(73) Assignee: Reeves Wireline Technology LTD, Leicester (GB)

( * ) Notice: Subject to any disclaimer, the term of this patent is extended or adjusted under 35 U.S.C. 154(b) by 0 days.

(21) Appl. No.: 09/449,057

(22) Filed: Nov. 24, 1999

(30) Foreign Application Priority Data

Nov. 28, 1998 (GB) ..... 9826007

(51) Int. Cl.[7] ..... E21B 47/12

(52) U.S. Cl. ..... 166/254.2; 175/40; 73/152.04; 73/152.19

(58) Field of Search ..... 166/66, 113, 254.2; 175/40; 73/152.02, 152.03, 152.04, 152.19, 152.43

(56) References Cited

U.S. PATENT DOCUMENTS

| | | | | |
|---|---|---|---|---|
| 4,041,780 A | * | 8/1977 | Angehrn | 73/151 |
| 4,064,939 A | | 12/1977 | Marquis | 166/253 |
| 4,166,500 A | | 9/1979 | McPhee | |
| 4,216,536 A | * | 8/1980 | More | 367/83 |
| 4,676,310 A | | 6/1987 | Scherbatskoy et al. | |
| 6,006,844 A | * | 12/1999 | Van Puymbroeck et al. | 175/50 |

FOREIGN PATENT DOCUMENTS

| | | |
|---|---|---|
| GB | 2297567 | 1/1995 |
| GB | 2344 123 A | 5/2000 |

* cited by examiner

*Primary Examiner*—David Bagnell
*Assistant Examiner*—Zakiya Walker
(74) *Attorney, Agent, or Firm*—Paul & Paul

(57) ABSTRACT

A well logging method and apparatus is described, which enables well logging to be conducted while still allowing passage of fluid mud within the well to maintain well control.

4 Claims, 4 Drawing Sheets

METHOD AND APPARATUS FOR WELL LOGGING AND WELL CONTROL

The present invention relates to a method and apparatus for well logging and well control.

In order to maintain well control it is necessary for a well to be filled with a fluid. Such fluids are usually mud mixtures and the density of the mud is usually controllable to suit particular conditions within a well, Such fluid is usually continuously pumped down a drill pipe and up the borehole between the pipe and the side of the borehole and the drill pipe.

The type of mud, in particular the density of mud which flows within the borehole may be carefully controlled to, for example, prevent escape of gas. For some wells the mud density may require to be much higher than for others. During the time that the well is in operation it may be necessary to change the density of the mud mixture to, for example, cope with additional gas pressure within the well.

In such circumstances, logging of the well becomes dangerous because circulation of fluid/mud is required and this is not achievable without drilipipe in the hole. Thus, many wells are not logged and because of this the full potential of the wells is not achieved.

Additionally, in a well which has a large wash-out at a depth below the surface, the logging cannot proceed past this section.

It is an object of the present invention to provide a method and apparatus for both well logging and simultaneous well control.

The present invention provides a method for well logging and well control comprising of a well:

a) inserting a well logging tool into the well, b) transporting said well logging tool down to a desired position in said well inside drillpipe and out into openhole, c) transporting said well logging tool upwardly in said well and logging data from said well as said tool is transported by wireline or drillpipe, d) continuing to supply fluid flow in said well, whilst said logging of data is taking place said fluid flowing through said data logging tool or around the outside if wireline conveyed, Preferably said method includes the step of e) increasing the pressure of the fluid flow in said well to energise said data logging tool to create a path through said tool for said fluid.

The present invention also provides apparatus for well logging and control said apparatus comprising fluid pump means for pumping fluid into a well, a well logging tool situated within said well, said well logging tool comprising fluid valve contact means for allowing fluid to pass through said logging tool to allow fluid contact to be maintained in said well.

The present invention may also comprise drill pipe means situated in said well, and drill pipe means extending over washout portions of said well.

In a specific embodiment the apparatus may include drill bit means said drill bit means comprising means for enabling said logging tool to protrude through said drill bit to enable logging to be completed without withdrawal of said drill bit means, said logging operation also enabling well control. And use pumpdown and reverse circulating technique to deploy and recover the logging tools.

Embodiment of the present invention will now be described by way of example with reference to the accompanying drawings in which:

FIG. 1 shows an apparatus according to the present invention for well logging and simultaneous well control.

FIG. 2 partially shows a well logging tool suitable for use in the present invention.

Figure 1:
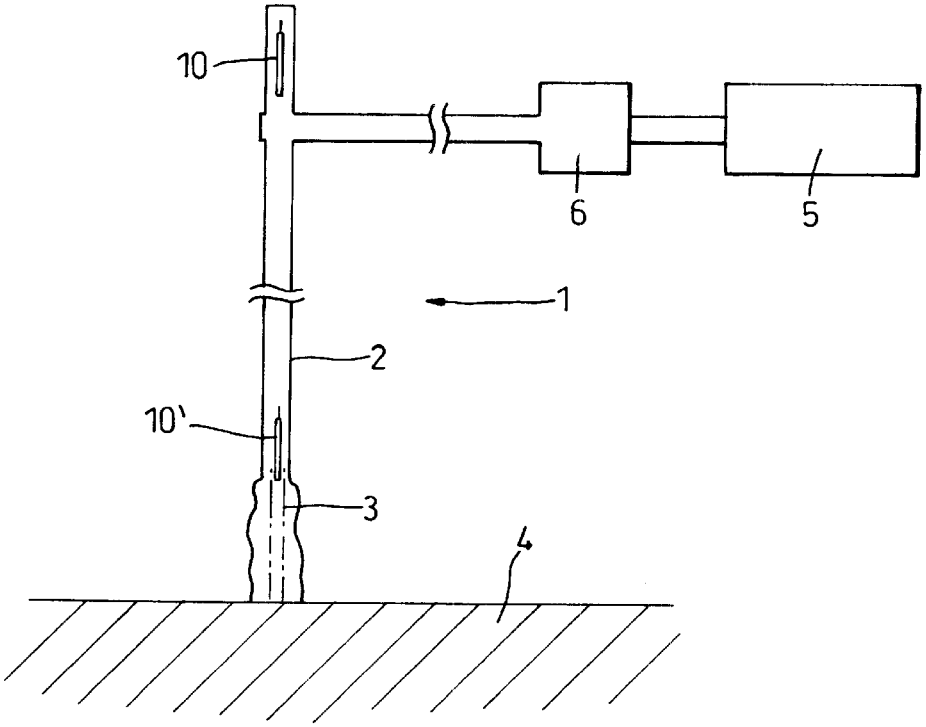

With reference now to FIG. 1, a well system 1 comprises a borehole 2 with a drill pipe 3 (shown dotted) positioned to cover part or all of the borehole. The well 4 is situated at the bottom of the borehole and contains a mud and gas mixture.

The well is supplied with well fluid comprising a mud mixture from a fluid supply system comprising a reservoir 5 and pumping system 6.

A logging tool is introduceable into the system via a catcher unit 8, the operation of which is more fully described in our co-pending UK patent application No. 9826017.7 filed on Nov. 28, 1998. The logging tool may be battery powered and therefore may operate freely within the well or may be operated more conventionally with a cable.

The logging tool is shown in a second position 10 towards the bottom of the well.

Figure 2:
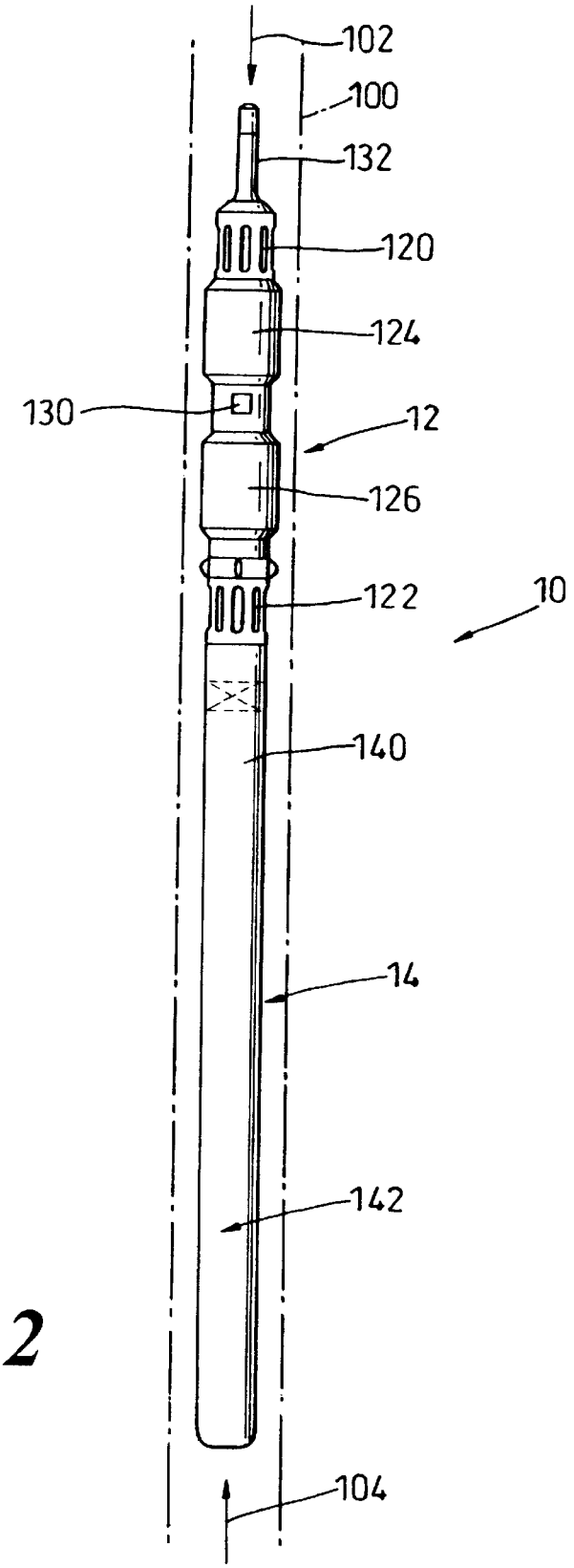
Figure 3:
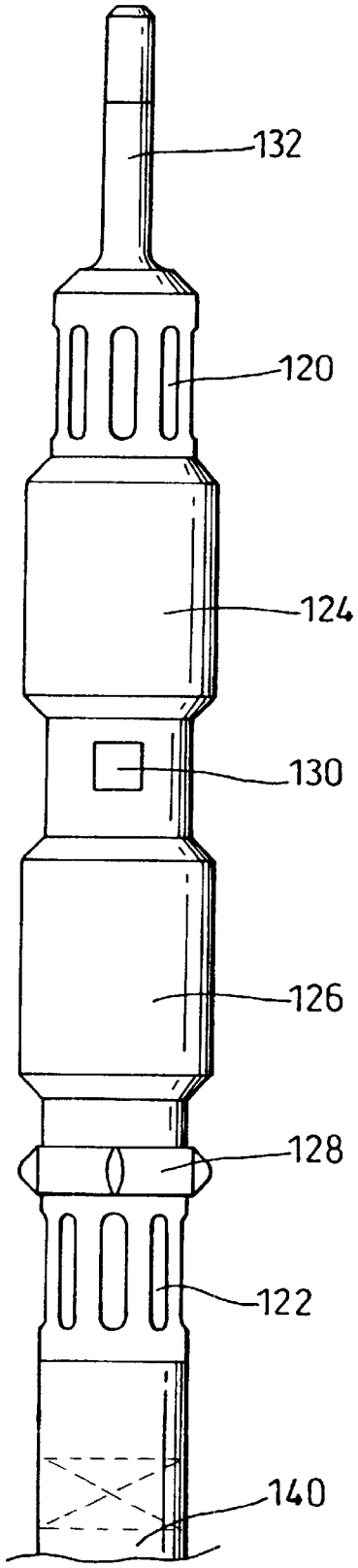
FIG. 3 shows the fluid flow unit of the well logging tool of FIG. 1 in greater detail.
Figure 4:
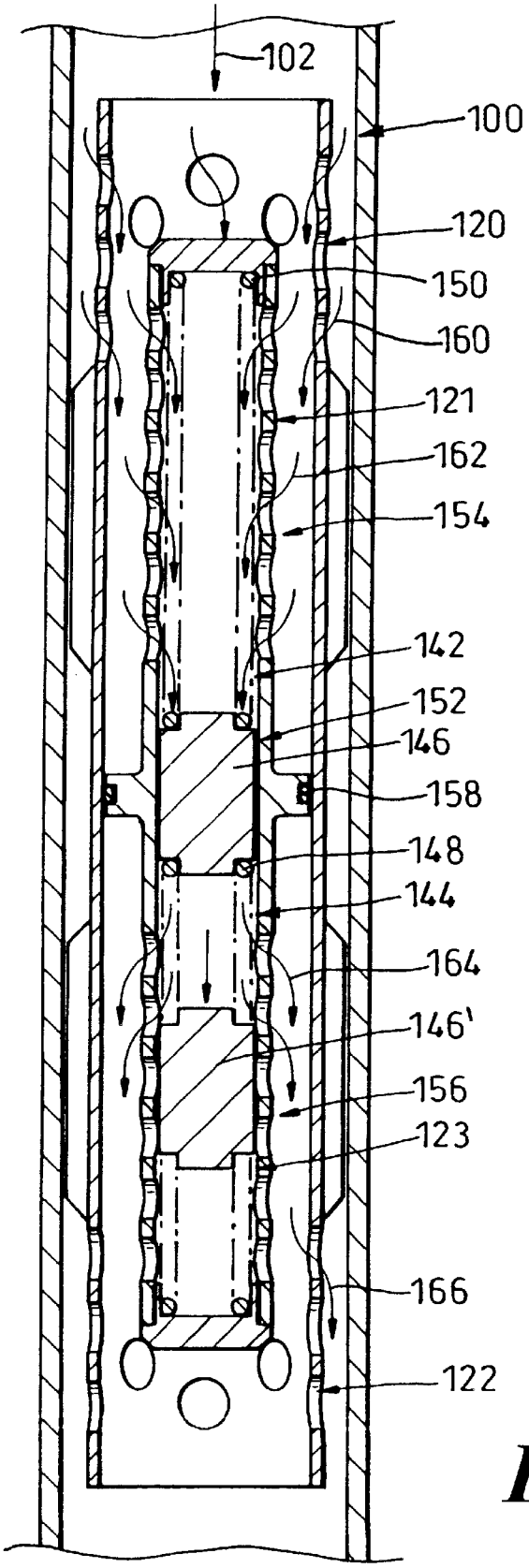
FIG. 4 shows the fluid flow unit of FIG. 2 in cross sectional elevation.

The logging tool may be of the type shown in FIGS. 2, 3 and 4.

With reference now to FIG. 2 the well logging tool 10 comprises a generally elongate cylindrical construction including a first upper section 12 and a second lower section 14. The phrases upper and lower sections are used to indicate the normal direction of insertion of the tool 10 into a borehole.

The first section 12 comprises a fluid flow unit, the operation of which will be explained in greater detail with reference to FIGS. 3 and 4.

The second lower section 14 comprises a well data logging section which may include a battery and memory pack section 140 and a calliper/sensor section 142.

The battery/memory section 140 enables the logging tool to be free from any control cables. The logging tool could, however, be connected by a conventional cable arrangement should this be preferred. Normally, however, the logging tool will be battery powered.

The data logging sensors and calliper unit may be of conventional designs which are well known in this art and therefore they will not be described further.

With reference now to FIG. 3, the fluid flow unit comprises a first upper fluid entry/exit port in the form of an upper grille 120 and a second lower fluid entry/exit port in the form of a lower grille 122.

Adjacent to the upper grille 120 is a larger diameter section 124 and adjacent to the lower entry port 122 is a further larger section 126. A segmented landing collar 128 is preferably situated between the lower grille 122 and the larger diameter section 126. This would not be used if the tool is wireline conveyed.

A differential pressure release valve 130 is situated between enlarged diameter sections 124, 126. A fishing neck 132 is provided at the upper end of section 12.

In operation the well logging tool will normally not allow fluid flow therethrough. Thus, when fluid pressure is applied within a drill pipe 100 (shown dotted in FIG. 2) in the direction of arrow 102 the logging tool will be propelled in that direction and in direction 104 when fluid pressure is applied in that direction.

The operation of the valve means is explained with reference to FIG. 4, which shows in cross section the operative part of the first section 12.

The valve means comprises two cylinders 142, 144 and a piston 146. Piston 146 is free to move within the cylinders, but is normally maintained in a central position as indicated by reference mineral 146 by two coil springs 148, 150.

Normally piston 146 closes the central portion 152 between cylinders 142, 144 and thus prevents any passage of fluid from grille 120 to grille 122. Passage of fluid via internal passages 154, 156 is prevented by suitable seal means 158. Thus, in normal use fluid pressure in the direction of arrow 102 will push on the end of 12 of logging tool 10 and cause it, unless it is obstructed, to move in the direction of arrow 102.

If the logging tool becomes stationary then the fluid flow 102 will be halted.

If in a preferred embodiment of the fluid pressure in drill pipe 100 remains the same as in the logging tool transportation mode, then piston 146 will not move substantially.

However, if pressure is allowed to build up on the side of inlet grille 120 then the differental pressure across piston 146 will increase and this will then force piston 146 downwardly until it is in position 146.

The fluid flow will then follow arrows 160, 162, 164, 166 allowing fluid to pass through grilles 120, 121, through cylinders 142, 144 and through grille 123 and outlet grille 122 to pass on down the drill pipe 100.

In like manner, if the fluid flow is reversed, piston 146 will move to the upper cylinder 142 and the fluid flow through the valve unit will occur in a reverse direction.

The valve unit therefore allows passage of fluid through the drill pipe at all times even when logging is occurring.

Well control is therefore achievable by increasing the pressure of the fluid within the well to ensure that the differential valve system in the logging tool 10 opens to allow passage of the fluid. The well can be logged continuously whilst the gas/oil within the well can be kept under control.

The use of sections 3 (FIG. 1) of drill pipe to "bridge" sections of the borehole where wash-out occurs is beneficial in control of the logging tool especially where the tool is free standing. The fluid flow can be monitored whilst the tool passes through such sections.

In a specific embodiment the apparatus may include drill bit means said drill bit means comprising means for enabling said logging tool to protrude through said drill bit to enable logging to be completed without withdrawal of said drill bit means, said logging operation also enabling well control. And use pumpdown and reverse circulating technique to deploy and recover the logging tools.

Figure 5:
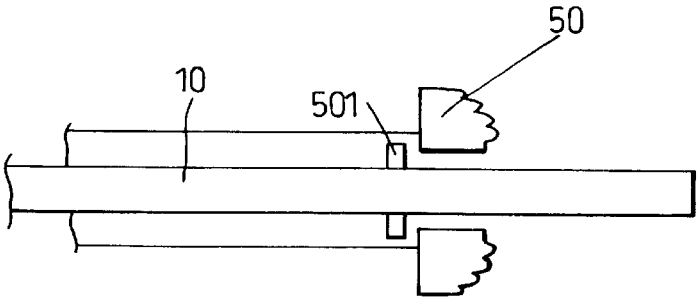
FIG. 5 illustrates a logging tool protruding through a drill bit.

In FIG. 5 the logging tool 10 is shown protruding through a hollow drill bit 50.

The tool is prevented from excess downward movement by a collar 501.

Thus the drill bit does not have to be returned to the surface in order to provide an open hole logging service.

What is claimed is:

1. A method for well logging and control of a well containing drillpipe having a drill bit secured at a downhole end thereof and the well having operatively connected thereto a pump for pumping fluid in the well, the method comprising:

a) inserting a well logging tool having a bi-directional differential pressure fluid valve contact means for allowing fluid to pass through the logging tool to allow the maintenance of fluid contact in the well, into the well;

b) providing fluid in the well for pumping said well logging tool down to a desired position in said well at a first fluid pressure level;

c) transporting said well logging tool upwardly in said well and logging data from said well while said well logging tool is transported; and d) continuing to pump said fluid in said well, while said logging of data is taking place, such that said fluid flows through said well logging tool;

wherein the drill bit includes means for enabling the logging tool to protrude through the drill bit; and wherein the desired position of the logging tool is that of protrusion of the logging tool through the drill bit, the method including logging of the well without prior withdrawal of the drill bit from the well.

2. The method for well logging as claimed in claim 1 further comprising the step of e) increasing the pressure of the fluid flow in said well to energize said well logging tool to create a path through said well logging tool for said fluid.

3. Apparatus for well logging and control comprising:

fluid pump means for pumping fluid into a well;

a drillpipe;

a well logging tool situated within said well and capable of being pumped to a location protruding from the drillpipe, said well logging tool comprising bi-directional differential pressure fluid valve contact means for allowing fluid to pass through said logging tool to allow fluid contact to be maintained in said well, said apparatus including a drill bit means, said drill bit means comprising means for enabling said well logging tool to protrude through said drill bit means to enable logging to be completed without withdrawal of said drill bit means, said logging operation also enabling well control.

4. Apparatus for well logging as claimed in claim 3 wherein said drillpipe extends over wash-out portions of said well.

* * * * *